US005674041A

United States Patent [19]

Smith, Jr. et al.

[11] Patent Number: 5,674,041

[45] Date of Patent: Oct. 7, 1997

[54] METHOD AND APPARATUS FOR TRANSPORTING AND TRANSFERRING A PERSON

[75] Inventors: Donald J. Smith, Jr., Prairie du Chien, Wis.; Patrick J. Atkinson, East Lansing, Mich.; Melissa L. Evans, Minnetonka, Minn.; Shawn P. Londo, Atlanta, Ga.; William J. Ryan, Rochester, Minn.

[73] Assignee: The Board of Trustees operating Michigan State University, East Lansing, Mich.

[21] Appl. No.: 484,671

[22] Filed: Jun. 7, 1995

[51] Int. Cl.[6] ..... A61Q 5/00

[52] U.S. Cl. ..... 414/345; 280/304.1; 280/250.1; 414/921; 414/786; 414/539; 5/87.1; 5/81.1 HS; 297/DIG. 4

[58] Field of Search ..... 414/340, 343, 414/344, 345, 346, 347, 348, 786, 525.1, 522, 529, 539, 540, 541, 542, 546, 467; 286/63, 65.1, 69; 254/2 R, 3 R; 280/47.16, 149.2, 105, 87.2, 47.25, 63, 64, 250.1, 47.21, 304.1; 297/DIG. 4; 5/81.1 HS, 86.1, 87.1

[56] References Cited

U.S. PATENT DOCUMENTS

| | | | |
|---|---|---|---|
| 3,099,020 | 7/1963 | Garfield et al. | 5/87.1 |
| 3,515,294 | 6/1970 | Southward et al. . | |
| 3,865,427 | 2/1975 | Delany . | |
| 4,170,368 | 10/1979 | Southward et al. . | |
| 4,278,387 | 7/1981 | Seguela et al. . | |
| 4,354,791 | 10/1982 | Antonellis . | |
| 4,457,663 | 7/1984 | Hems et al. . | |
| 4,483,653 | 11/1984 | Waite . | |
| 4,669,943 | 6/1987 | Zamotin . | |
| 5,110,173 | 5/1992 | Megna . | |
| 5,201,377 | 4/1993 | Wilson | 414/921 X |
| 5,207,549 | 5/1993 | Riva . | |
| 5,419,571 | 5/1995 | Vaughan | 280/304.1 X |

FOREIGN PATENT DOCUMENTS

| | | | |
|---|---|---|---|
| 2410960 | 9/1974 | Germany | 297/DIG. 4 |
| 3403441 | 7/1984 | Germany | 5/81.1 HS |
| 220195 | 8/1993 | Japan | 280/304.1 |
| 2141980 | 1/1985 | United Kingdom | 280/250.1 |

*Primary Examiner*—Frank E. Werner

*Attorney, Agent, or Firm*—Ian C. McLeod; Mary M. Moyne

[57] ABSTRACT

A method and vehicle preferably a wheelchair (10) for transporting and transferring an invalid person is described. The wheelchair has first and second frames (12 and 48) with drive wheels (18) between which is provided a chair (82) or support (83). The first frame has top and bottom sliding mechanisms (34 and 36) which are mounted by I-beam extensions (38 and 40) to the bars (24 and 26) of the first frame. The second frame has top and bottom rails (54 and 56) which are slidably connected to the sliding mechanisms of the first frame. The rails have slots (78) through which extend the center portions (38C and 40C) of the extensions which allow the first frame to move along the length of the rails. The bottom rails have front wheels (60), intermediate wheels (68) and stabilizing wheels (70). The chair is connected to the second frame by belts (84) and ratchets (86) and has a lifting system (90). In use, the wheelchair is moved adjacent the open doorway (104) of the automotive vehicle (100) and the second frame with the chair and person are slid over the seat (102). As the second frame moves, the second frame tilts such that the intermediate wheels touch the ground surface (72). The seat is lowered using the ratchets and removed from the wheelchair.

41 Claims, 8 Drawing Sheets

METHOD AND APPARATUS FOR TRANSPORTING AND TRANSFERRING A PERSON

BACKGROUND OF THE INVENTION

1. Field of the Invention

The present invention relates to a method and apparatus for transporting and transferring an invalid person. In particular, the present invention relates to a method and apparatus for transporting and transferring an invalid person in either the sitting or resting position to and from and into and out of an automotive vehicle. The method and apparatus uses a modified wheelchair in which the chair of the wheelchair is able to be moved into the automotive vehicle and deposited onto the seat of the automotive vehicle. The chair can be replaced with other types of supports in order to accommodate persons in different positions. The present invention requires no modification of the automotive vehicle and the modified wheelchair is able to be used similarly to a standard wheelchair for transporting the invalid person.

2. Prior Art

The prior art has shown various methods and apparatus for transferring an invalid person to and from a motor vehicle. Illustrative are U.S. Pat. Nos. 3,515,294 to Southward et al; 3,865,427 to Delany; 4,170,368 to Southward et al; 4,278,387 to Seguela et al; 4,354,791 to Antonellis; 4,457,663 to Hems et al; 4,483,653 to Waite; 5,207,549 to Riva and 5,110,173 to Megna. The methods and apparatuses of the above prior art require modification of the automobile either by way of installation of a lifting device or by including a support or rail on the vehicle seat.

In particular, Megna shows a wheelchair having a removable chair portion. The bottom of the chair has rollers which engage first guides located on the frame of the wheelchair. To transfer the seat to the vehicle, the chair is unlocked and slideably disengaged from the first guides and transferred to second guides located on an auxiliary supporting structure in the vehicle. Once the chair is fully in place on the auxiliary supporting structure, the auxiliary supporting structure can be rotated to orient the user toward the front of the vehicle. In this invention, the vehicle must be provided with an auxiliary supporting structure which has guides to accommodate the rollers of the chair.

In addition, U.S. Pat. No. 4,669,943 to Zamotin describes a wheelchair which allows the chair to be separated from the wheeled chassis in order to transfer a person into a motor vehicle. The chair is raised vertically and the wheeled chassis is moved under the sill of the vehicle in order to position the chair over the automobile seat. Once the chair is over the automobile seat, the support for the chair is rotated in order to align the chair with the seat in the automobile. The chair is then lowered onto the automobile seat. The wheeled chassis must be specially constructed in order to slide beneath the sill of the automobile. Further, the wheelchair cannot have large hand operated drive wheels as the wheels would prevent the chassis from moving far enough beneath the automobile so as to position the chair fully over the automobile seat.

There remains a need for a method and apparatus for moving an invalid person into and out of an automotive vehicle which will work with virtually any make of automotive vehicle which does not require modification of the automotive vehicle and which enables the wheelchair to be used similarly to a standard wheelchair for transporting the invalid person.

OBJECTS

It is an object of the present invention to provide a method and apparatus for transporting and transferring an invalid person to and from and into and out of an automotive vehicle. Further, it is an object of the present invention to provide a method and apparatus for transferring an invalid person into and out of an automotive vehicle which slides the chair of the wheelchair into the automotive vehicle and deposits the chair of the wheelchair onto the seat of the automotive vehicle. Still further, it is an object of the present invention to provide a method and apparatus for transferring an invalid person into and out of an automotive vehicle which does not require modification of the automotive vehicle. Furthermore, it is an object of the present invention to provide a method and apparatus for transporting and transferring an invalid person to and from and into and out of an automotive vehicle which allows the wheelchair to be used similarly to a standard wheelchair to transport the invalid person. Still further, it is an object of the present invention to provide a method and apparatus for transporting and transferring an invalid person to and from and into and out of an automotive vehicle which is economical to construct and which is easy to use. Finally, it is an object of the present invention to provide a method and apparatus for transporting and transferring an invalid person to and from and into and out of an automotive vehicle which is able to be used by the invalid person without the assistance of another person. These and other objects will become increasingly apparent by reference to the following description and to the drawings.

DETAILED DESCRIPTION OF THE PREFERRED EMBODIMENTS

Figure 1:
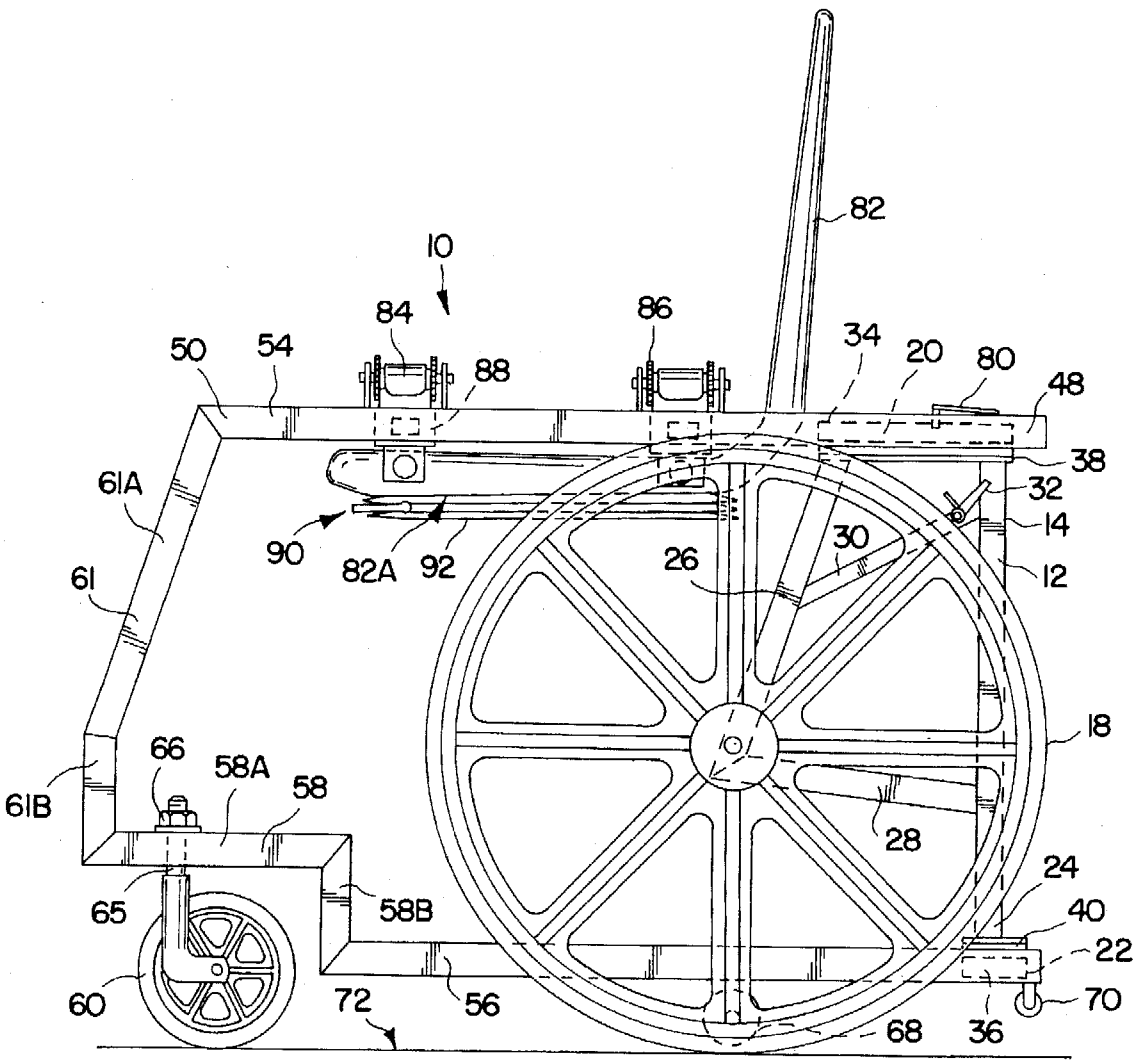
FIG. 1 is a side view of the wheelchair 10 of the present invention in the initial transport position.

The present invention relates to a vehicle for allowing transport and transfer of a person, which comprises: a first frame mounted on a pair of spaced apart wheels having a common axis of rotation; a second frame having a first end and a second end and slidably connected to the first frame for movement along a horizontal direction along the first frame, the second frame having first wheels at the first end and second wheels intermediate the first and second ends, wherein when the second frame is moved along the first frame with the wheels of the first frame and the first end of the second frame moving toward each other, the second frame tilts so that the second wheels engage a ground surface for supporting the second frame during the movement; and a support means mounted on the second frame for supporting the person during transport and transfer.

Further, the present invention relates to a wheelchair for allowing transport and transfer of a person to and from and into and out of a receiving vehicle, which comprises: a first frame mounted on a pair of spaced apart hand driveable drive wheels having a common axis of rotation; a second frame having a first end and a second end and slidably connected to the first frame for movement along a horizontal direction along the first frame, the second frame having first wheels at the first end and second wheels intermediate the first and second ends, wherein when the second frame is moved along the first frame with the drive wheels moved toward the front end of the second frame, the second frame tilts so that the second wheels engage a ground surface for supporting the second frame during the movement; and a chair mounted on the second frame for supporting the person during transfer from and into the receiving vehicle wherein the rotation of the drive wheels of the first frame is prevented while the second frame is moved into the receiving vehicle.

Still further, the present invention relates to a wheelchair for allowing transport and transfer of a person to and from and into and out of a receiving vehicle, which comprises: a first frame having spaced apart first and second sides, each side having spaced apart, parallel top and bottom portions and each side connected to spaced apart hand driveable drive wheels having a common axis of rotation; a second frame having a first end and a second end slidably connected to the first frame for movement along a horizontal direction along the first frame and having spaced apart first and second sides with each side having spaced apart top and bottom rails, each bottom rail having a first wheel at the first end and a second wheel intermediate the first and second ends, wherein the top rail of the second frame is slidably connected to the top portion of the first frame and the bottom rail of the second frame is slidably connected to the bottom portion of the first frame to allow the second frame to move while the first frame remains stationary; and a chair mounted between the sides of the second frame.

Furthermore, the present invention relates to a method for transporting and transferring a person, which comprises: providing a vehicle having a first frame mounted on a pair of spaced apart wheels having a common axis of rotation; a second frame having a first end and a second end, slidably connected to the first frame for movement along a horizontal direction along the first frame, the second frame having first wheels at the first end and second wheels intermediate the first and second ends; a support means mounted on the second frame for supporting the person during transfer; sliding the frames so that the first end of the second frame and the wheels of the first frame move toward each other wherein the second frame tilts so that the second wheels engage a ground surface for supporting the second frame during the movement; and removing the person from the vehicle.

Finally, the present invention relates to a method for transporting and transferring a person to and from and into and out of a receiving vehicle, which comprises: providing a wheelchair having a first frame mounted on a pair of spaced apart driveable drive wheels having a common axis of rotation; a second frame having a first end and a second end and slidably connected to the first frame for movement along a horizontal direction along the first frame, the second frame having first wheels at the first end and second wheels intermediate the first end and the second end, wherein when the second frame is moved along the first frame with the first end of the second frame moved towards the drive wheels, the second frame tilts so that the second wheels engage a ground surface for supporting the second frame during the movement; and a chair mounted on the second frame for supporting the person during transport to and from and out of transfer and into the receiving vehicle wherein rotation of the drive wheels of the first frame is prevented while the second frame is moved adjacent the receiving vehicle; positioning the wheelchair adjacent an open door of the receiving vehicle so that the driving wheels are adjacent the receiving vehicle; holding the wheelchair in a fixed position; sliding the second frame backwards toward the open door so that the chair is spaced above a seat of the receiving vehicle; lowering the chair of the wheelchair onto the seat of the receiving vehicle and removing the chair from the second frame; and rotating the chair of the wheelchair on the seat of the receiving vehicle so that the person is correctly positioned in the receiving vehicle.

The frames of the vehicle or wheelchair for moving the invalid person are preferably connected such that the top sliding mechanism on the top portion of the first frame engages the top rail of the second frame. Likewise, the bottom sliding mechanism on the bottom portion of the first frame engages the bottom rail of the second frame. The sliding mechanisms are mounted to the top and bottom portions of the first frame by I-beam shaped extensions. The center portion of the extension slides along a slot in the bottom or top of the top or bottom rail, respectively, of the second frame. The sliding mechanisms are square tubular members with rollers in and along all walls of the member. The rollers allow the sliding mechanisms to easily slide within the opening of the rails. The bottom rails of the second frame are also provided with stabilizing wheels to prevent the wheelchair or vehicle from tipping over.

The chair or support of the vehicle or wheelchair is mounted between the sides of the frames. The chair or support is preferably connected to the top rails of the second frame by a ratchet and belt system which allows incremental lowering of the chair or support and quick release of the chair or support from the wheelchair or vehicle. A lifting system is provided beneath the chair or support to raise the chair or support for reattachment to the vehicle or wheelchair.

Figure 2:
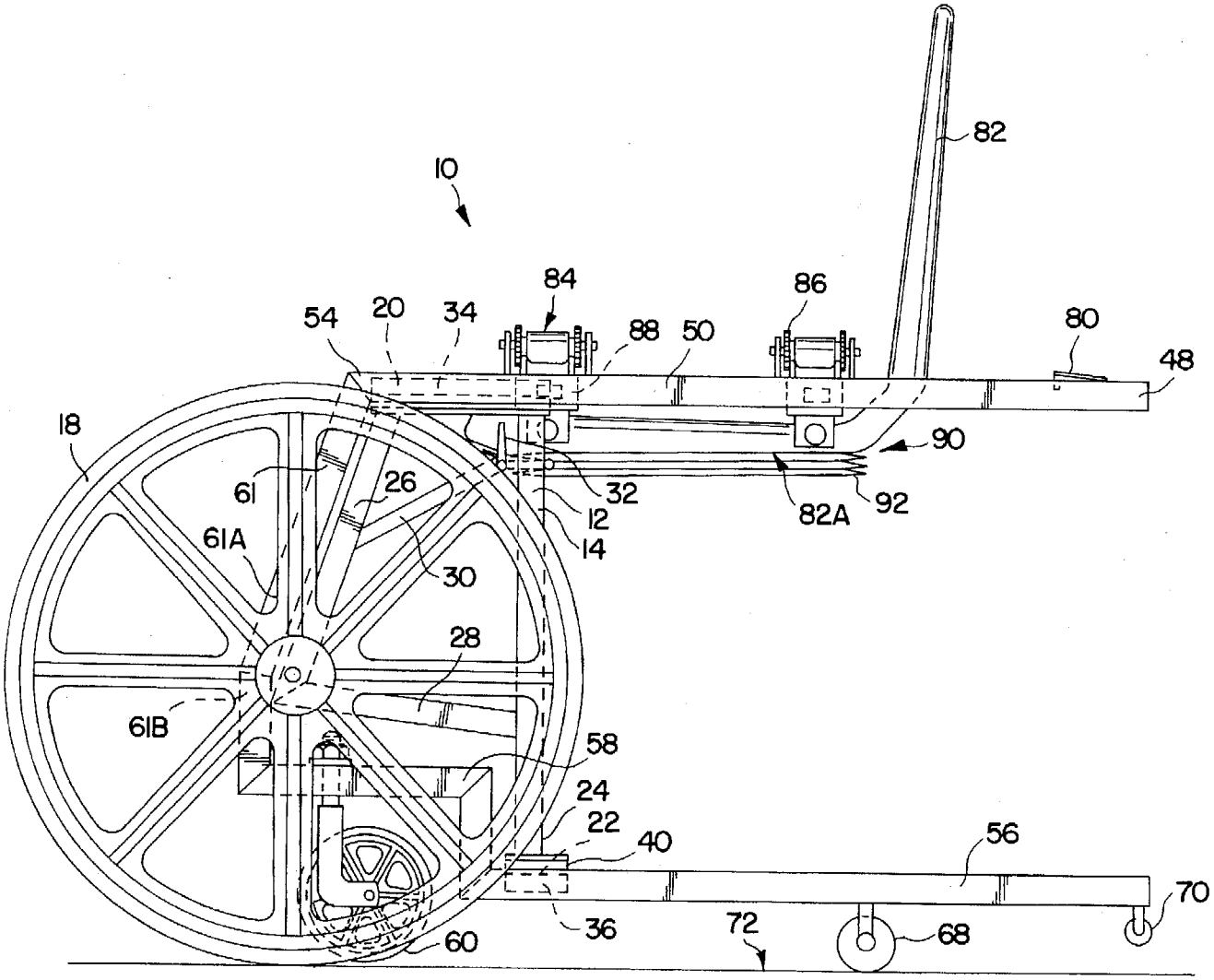
FIG. 2 is a side view of the wheelchair 10 of FIG. 1 in the final transfer position.

FIGS. 1 to 3 and 5 to 7 show the vehicle, preferably a wheelchair 10, of the present invention. The wheelchair 10 includes a first frame 12 and a second frame 48 which are slidably connected together. The first frame 12 has a first and second side 14 and 16 positioned between coaxially mounted drive wheels 18 for hand powering the wheelchair 10. The sides 14 and 16 of the first frame 12 are connected together by a horizontal connector bar 17. The connector bar 17 is preferably adjacent the bottom of the frame 12 so as to not interfere with the user's feet or legs (not shown) during movement of the wheelchair 10 from the transport position to the transfer position (FIGS. 1 and 2). The connector bar 17 acts to stabilize the sides 14 and 16 of the first frame 12 and causes the first and second sides 14 and 16 to move in unison thus, preventing twisting of the first frame 12. The first and second sides 14 and 16 are preferably identical and therefore, only the first side 14, as shown in FIG. 1, will be described in detail. The first side 14 of the first frame 12 has a top portion 20 and a bottom portion 22 connected together by a vertical bar 24 extending between one end of the top and bottom portions 20 and 22. The first frame 12 also contains a vertically angled bar 26 and first and second horizontally angled bars 28 and 30. The vertically angled bar 26 extends from the end of the top portion 20 opposite the vertical bar 24 forward to the center of the drive wheel 18. The first horizontally angled bar 28 extends from the vertical bar 24 slightly upward to the center of the drive wheel 18. Preferably, the ends of the angled bars 26 and 28 adjacent the center of the drive wheel 18 are mounted together and allow for mounting of the drive wheel 18. The second horizontally angled bar 30 is mounted to the vertical bar 24 above the first horizontally angled bar 28 and angles downward from the vertical bar 24 to the vertically angled bar 26. The second horizontally angled bar 30 preferably has a round tubular shape and is positioned such as to accommodate a brake 32 (to be described in detail hereinafter). The specific structure of the first frame 12 is such as to provide the necessary strength to the first frame 12 and to prevent twisting of the first frame 12. Preferably, the bars 26 and 28 of the first frame 12 are constructed from square tubular lightweight and strong material.

A brake 32 is mounted on the second horizontally angled bar 30 behind the drive wheel 18 (FIG. 1). The brake 32 is preferably similar to conventional brakes found on standard wheelchairs and when activated prevents rotation of the drive wheel 18 of the wheelchair 10. Preferably, there is a brake 32 adjacent each of the drive wheels 18 such that both the drive wheels 18 are prevented from rotating during the transfer operation.

Figure 4:
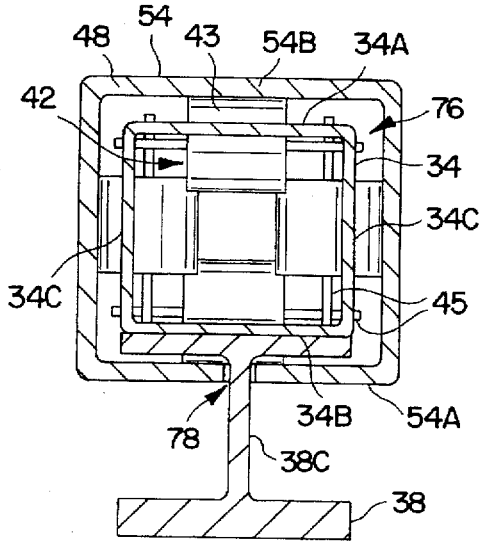
FIG. 4 is a cross-sectional view of the top rail 54 of the second frame 48 showing the top sliding mechanism 34 within the opening 76 of the top rail 54 and the upper I-beam extension 38 extending through the slot 78 of the top rail 54 of the second frame 48.
Figure 9:
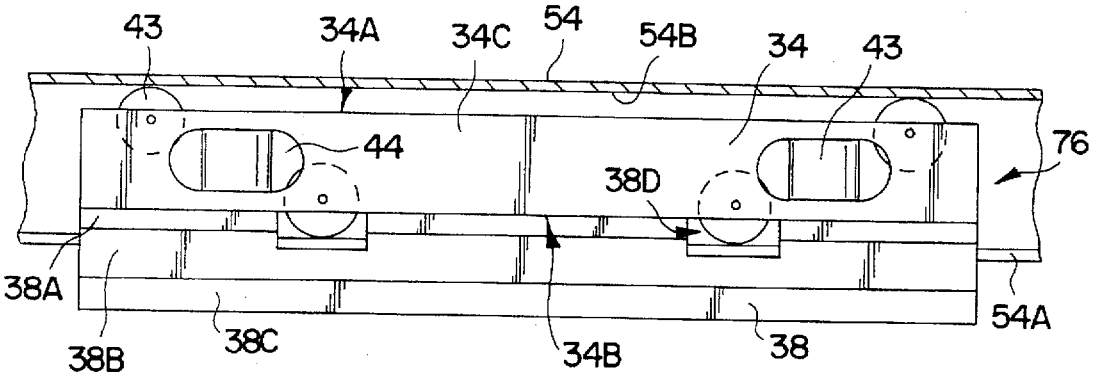
FIG. 9 is a partial cross-sectional side view of the top rail 54 with the top sliding mechanism 34 in elevation showing the rollers 43 in the notches 38D in the upper I-beam 38.
Figure 10:
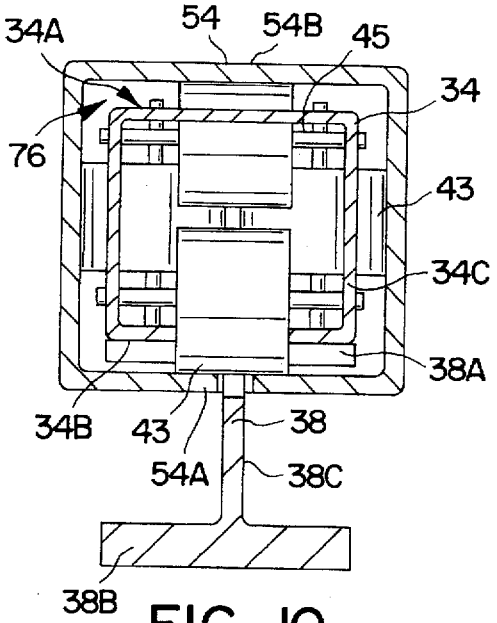
FIG. 10 is a cross-sectional view of the top sliding mechanism 34 in the top rail 54 through one of the notches 38D showing the rollers 43 mounted on the pins 45 on all sides 34A, 34B and 34C of the sliding mechanism 34.

The top and bottom portions 20 and 22 of the first frame 12 include top and bottom sliding mechanisms 34 and 36, respectively. As shown in FIGS. 4, 9 and 10, the top sliding mechanism 34 is comprised of a top wall 34A, a bottom wall 34B and two side walls 34C surrounding a hollow interior 42. The walls 34A, 34B and 34C of the sliding mechanism 34 are provided with rollers 43 along the length of the sliding mechanism 34. The rollers 43 are mounted in holes 44 in the walls 34A, 34B and 34C of the sliding mechanism 34. The rollers 43 extend inward into the hollow interior 42 of the sliding mechanism 34 and extend outward through the holes 44 beyond the walls 34A, 34B and 34C of the sliding mechanism 34. The rollers 43 can be mounted in the walls 34A, 34B and 34C of the sliding mechanism 34 in a number of ways. In the preferred embodiment, the rollers 43 are rotatably mounted on pins 45 which extend through the walls 34A, 34B and 34C and which allow the rollers 43 to rotate freely. Preferably, there are several rollers 43 along each wall 34A, 34B and 34C of the sliding mechanism 34. The rollers 43 can be constructed of a variety of materials such as rubber, nylon, plastic or steel.

The top sliding mechanism 34 is mounted to the vertical bar 24 and to the end of the vertically angled bar 26 opposite the drive wheel 18. The top sliding mechanism 34 is mounted to the bars 24 and 26 by an upper I-beam extension 38. The upper I-beam extension 38 has a top 38A and a bottom 38B with a center portion 38C, therebetween. The bottom wall 34B of the top sliding mechanism 34 is mounted onto the top 38A of the upper I-beam extension 38 opposite the vertical bar 24 of the first side 14 of the first frame 12 (FIGS. 4, 9 and 10). The top 38A of the upper I-beam extension 38 is provided with notches 38D which allow the rollers 43 mounted on the bottom wall 34B of the sliding mechanism 34 to come in contact with the top rail 54 (to be described in detail hereinafter).

Figure 7:
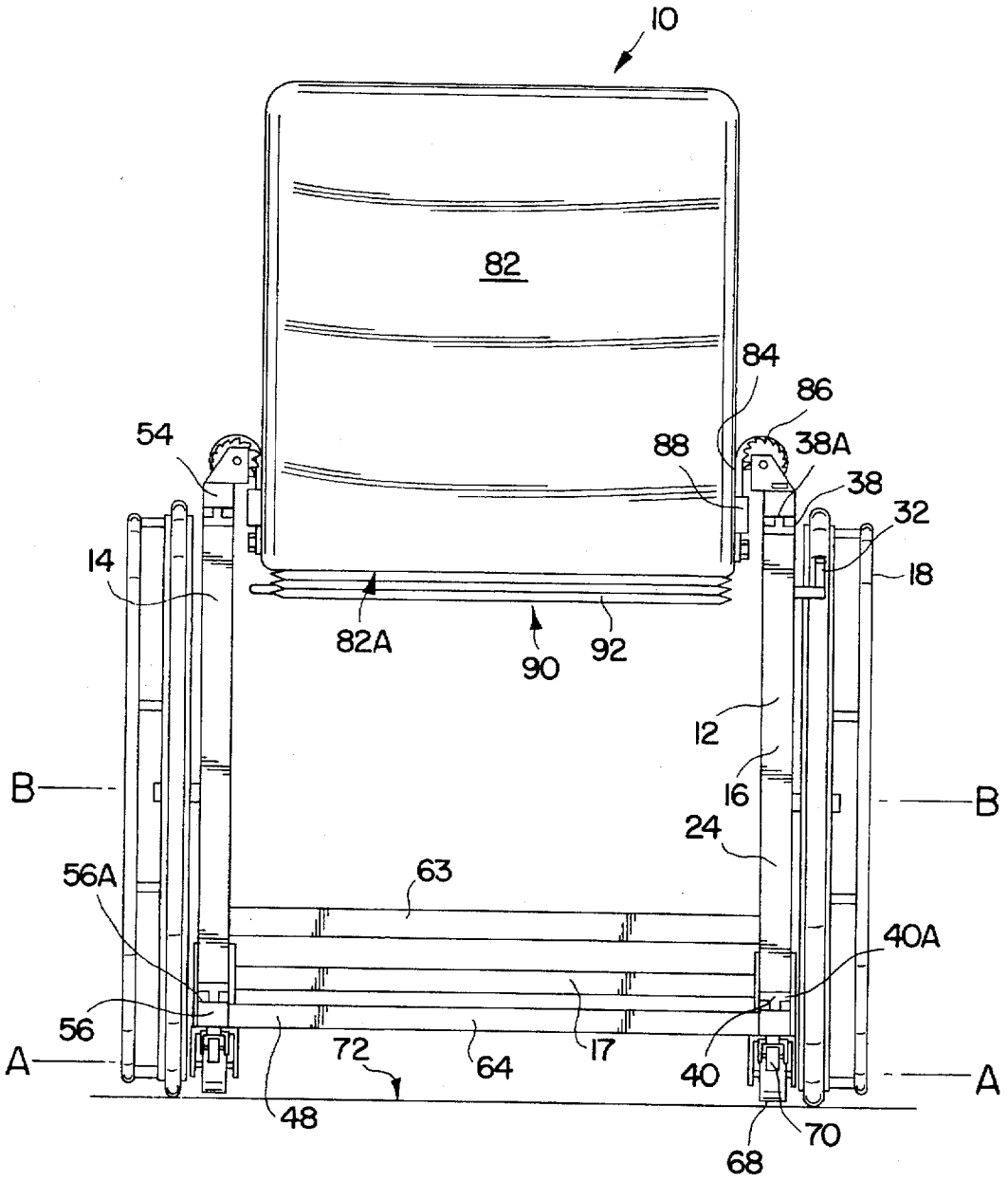
FIG. 7 is a rear view of the wheelchair 10 in the transport position showing the intermediate wheels 68 spaced above the ground surface 72.
Figure 11:
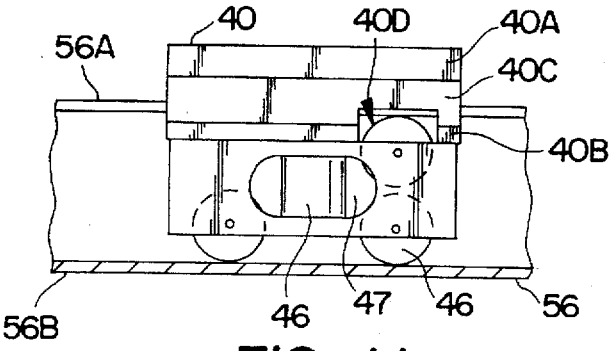
FIG. 11 is a partial cross-sectional side view of the bottom rail 56 with the bottom sliding mechanism 36 in elevation showing the rollers 46 on the bottom sliding mechanism 36 and the lower I-beam extension 40 with the notch 40D.

The bottom sliding mechanism 36 is similar in structure to the top sliding mechanism 34 and has a top wall 36A, a bottom wall 36B and two sidewalls 36C (one shown) surrounding a hollow interior (not shown). The bottom sliding mechanism 36 also has rollers 46 mounted in the walls 36A, 36B and 36C of the bottom sliding mechanism 36 and which extend through holes 47 in the walls 36A, 36B and 36C such as to make contact with the bottom rail 56 (to be described in detail hereinafter). The bottom sliding mechanism 36 is mounted opposite from the top sliding mechanism 34 such that the bottom sliding mechanism 36 extends downward from the bottom 40B of the lower I-beam extension 40 mounted at the lower end of the vertical bar 24 (FIGS. 7 and 11). The lower I-beam extension 40 is similar but opposite to the upper I-beam extension 38 such that the bottom 40B of the lower I-beam extension 40 is similar to the top 38A of the upper I-beam extension 38 and has notches 40D which allow the rollers 46 of the bottom sliding mechanism 36 to contact the bottom rail 56.

Preferably, the top sliding mechanism 34 is longer than the bottom sliding mechanism 36 and is mounted such that the vertical bar 24 of the first frame 12 is connected to the one end of the top sliding mechanism 34 and the angled vertical bar 26 of the first frame 12 is connected to the other end of the top sliding mechanism 34 (FIGS. 1 and 2). The I-beam extensions 38 and 40 extend along the entire length of the top and bottom sliding mechanisms 34 and 36, respectively, such that the angled vertical bar 26 is mounted to the upper I-beam extension 38 of the top sliding mechanism 34 similarly to the mounting of the vertical bar 24 to the upper and lower I-beam extensions 38 and 40 of the top and bottom sliding mechanisms 34 and 36, respectively. The connection of the angled vertical bar 26 to the top sliding mechanism 34 adds stability and support to the first frame 12.

The second frame 48 has right and left sides 50 and 52 which are slidably connected to the first frame 12 between the drive wheels 18 of the first frame 12. The right and left sides 50 and 52 of the second frame 48 are preferably identical and therefore, only the right side 50 as shown in FIGS. 1 and 2 will be described in detail. The right side 50 has a top and bottom rail 54 and 56 for receiving the top and bottom sliding mechanisms 34 and 36, respectively, of the first frame 12. The bottom rail 56 is preferably shorter than the top rail 54 and connected at one end to a step section 58 which accommodates the front wheel 60 of the second frame 48. The step section 58 consists of a horizontal bar 58A and a vertical bar 58B. The vertical bar 58B extends between the bottom rail 56 and one end of the horizontal bar 58A. The other end of the horizontal bar 58A is connected to a front section 61 of the second frame 48 which extends between the top rail 54 and the horizontal bar 58A of the step section 58. The front section 61 contains an angled upper portion 61A and a vertical lower portion 61B. Preferably, the angled upper portion 61A is angled similar to the vertically angled bar 26 of the first frame 12 such as to not interfere with the movement of the first frame 12 to the final transfer position (FIG. 2). The exact shape of the front section 61 depends on the respective lengths of the top and bottom rails 54 and 56 and the shape and size of the first frame 12.

The right and left sides 50 and 52 of the second frame 48 are connected together by a first and second horizontal connector bar 63 and 64. The first horizontal connector bar 63 extends between the bottoms of the front sections 61 and 62 of the sides 50 and 52 adjacent the horizontal bar 58A of the step section 58. The second horizontal connector bar 64 extends between the ends of the bottom rails 56 adjacent the step section 58 (FIG. 7). The horizontal connector bars 63 and 64 connect the sides 50 and 52 of the second frame 48 together and provides support and strength for the second frame 48. The connector bars 63 and 64 also prevent twisting or distorting of the second frame 48.

Figure 5:
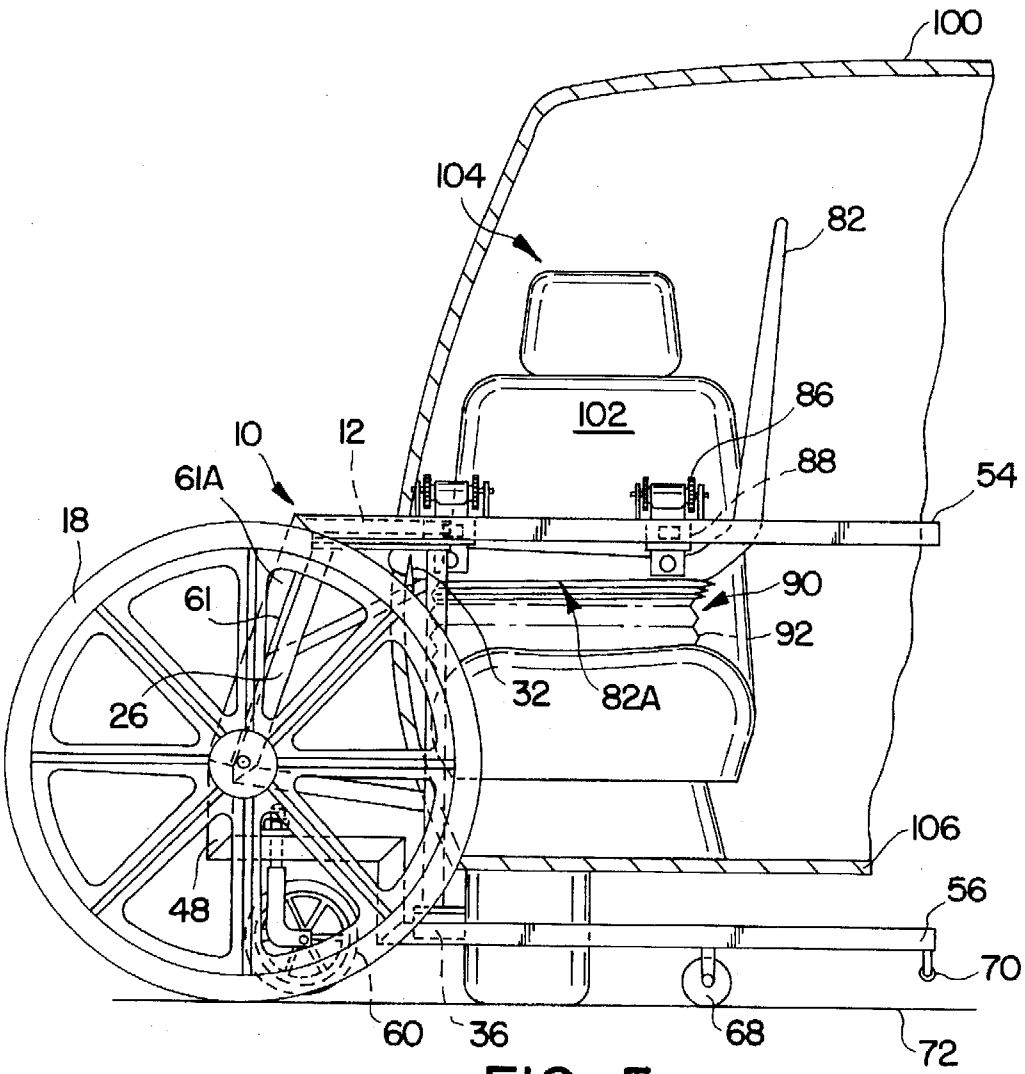
FIG. 5 is a front, cut away view of the passenger side of the automotive vehicle 100 showing the wheelchair 10 in the final transfer position with the chair 82 positioned over the passenger seat 102 of the automotive vehicle 100 and showing the lifting bellows 92 in the raised and lowered positions.
Figure 6:
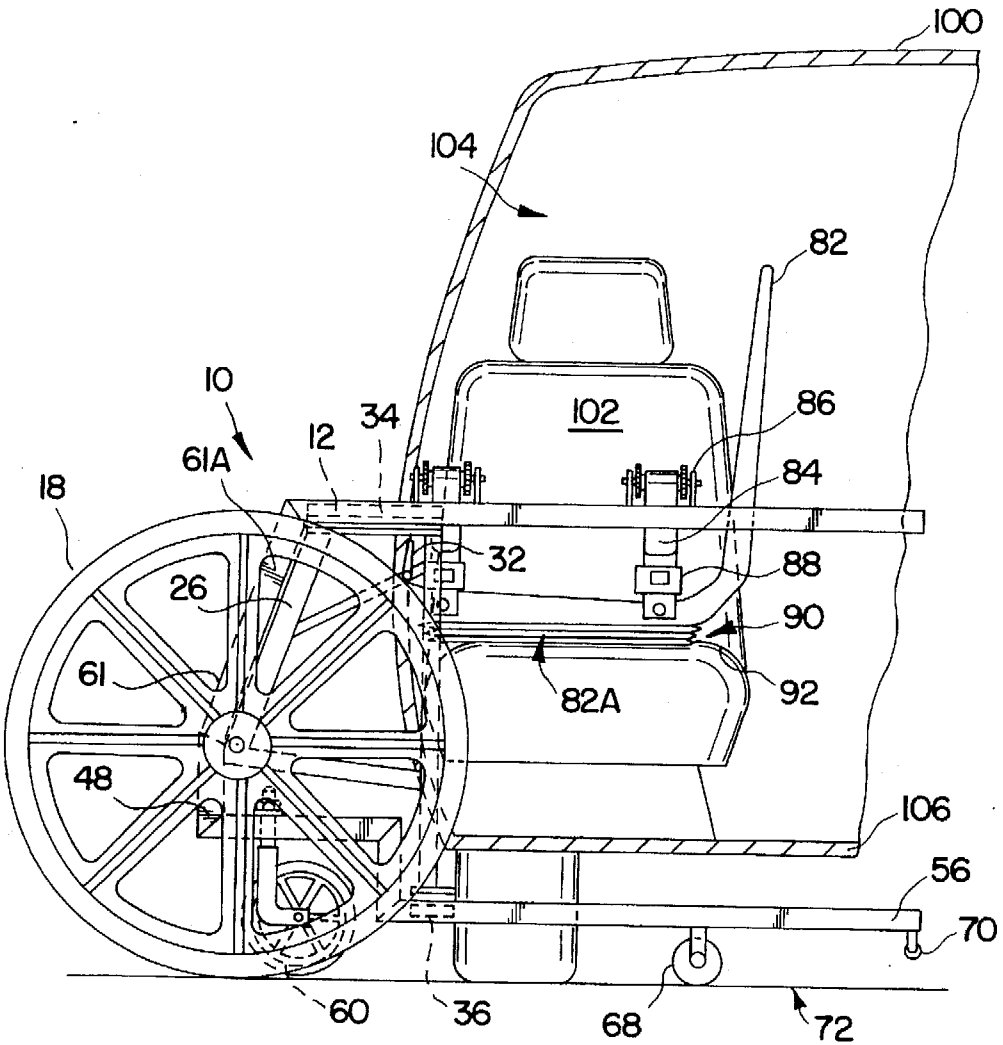
FIG. 6 is a front, cut away view of the passenger side of the automotive vehicle 100 showing the chair 82 fully lowered onto the seat 102 of the automotive vehicle 100.

The horizontal bar 58A of the step section 58 is provided with a front wheel 60 which supports the front of the wheelchair 10. Preferably, the front wheel 60 is similar to the front wheels of conventional wheelchairs and provides some steering capability to the wheelchair 10. The front wheel 60 is mounted through the horizontal bar 58A of the step section 58 by a shaft 65 having threads on the upper end and is secured on the bar 58A by a nut 66. The shaft 65 is preferably able to rotate within the bar 58A such as to enable the wheel 60 to turn in the direction of motion. The bottom rail 56 is provided with an intermediate wheel 68 and a stabilizing wheel 70. When the wheelchair 10 is in the transport position, the intermediate wheel 68 is coaxial with the drive wheel 18 and spaced above the ground surface 72 (FIG. 1). The intermediate wheel 68 provides support for the back end of the second frame 48 as the wheelchair 10 is moved into the transfer position (FIGS. 2, 5 and 6). The stabilizing wheel 70 is preferably located at the end of the bottom rail 56 opposite the step section 58. The stabilizing wheel 70 is preferably smaller than the intermediate wheel 68 and only contacts the ground surface 72 if the wheelchair 10 accidently tips too far backward during transfer. Thus, this stabilizing wheel 70 prevents the wheelchair 10 from accidently tipping over during transfer, while at the same time prevents the end of the bottom rails 56 from contacting the ground surface 72 during transfer.

The top and bottom rails 54 and 56 are preferably square, hollow tubular members having a square opening 76 and 77 through the center. The bottom wall 54A of the top rail 54 is provided with a slot 78 along the entire length of the top rail 54 (FIG. 4). The bottom rail 56 conversely has a slot 79 in the top wall 56A along the entire length of the bottom rail 56. The slots 78 and 79 are preferably of a width such that the center portions 38C and 40C of the I-beam extensions 38 and 40 can easily slide along the slot 78. The slot 78 of the top rail 54 enables the sliding mechanism 34 to be located within the opening 76 of the top rail 54 and to be connected to the vertical bar 24 and vertically angled bar 26 of the first frame 12. Similarly, the slot 79 in the top wall 56A of the bottom rail 56 enables the bottom sliding mechanism 36 to be located within the opening 77 of the bottom rail 56 and to be connected to the vertical bar 24. This construction enables the first frame 12 and the second frame 48 to slidably move with respect to each other. A position lock 80 is mounted on the top wall 54B of the top rail 54 and extends through a hole (not shown) in the top wall 54B into a hole (not shown) in the top wall 34A of the top sliding mechanism 34 (FIG. 1). The position lock 80 secures the first frame 12 and second frame 48 together in the transport position. Alternately, there can be a lock 80 on each side 50 and 52 of the second frame 48. In the preferred embodiment, the first and second frames 12 and 48 are constructed of hollow, square tubing made of a lightweight, high strength material. Any material may be used provided the material used provides enough strength.

Figure 3:
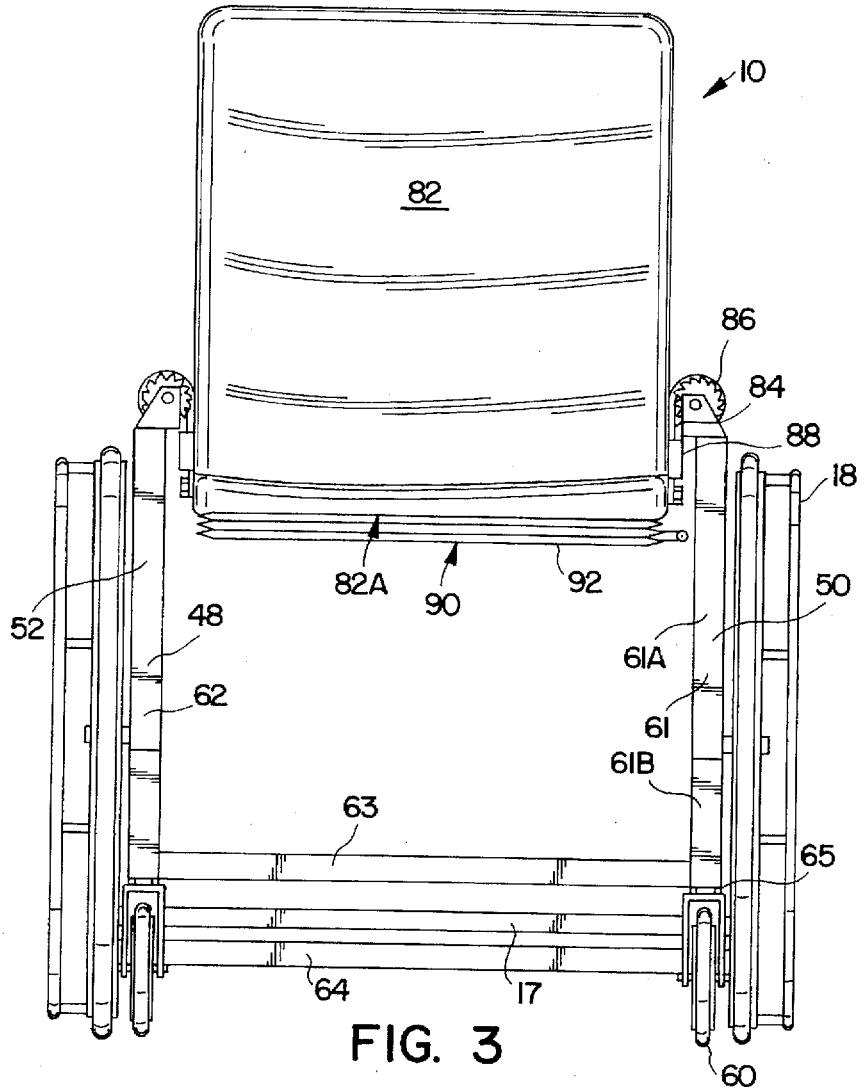
FIG. 3 is a front view of the wheelchair 10 of FIG. 1 showing the second frame 48 and the front wheels 60 positioned between the drive wheels 18.
Figure 8:
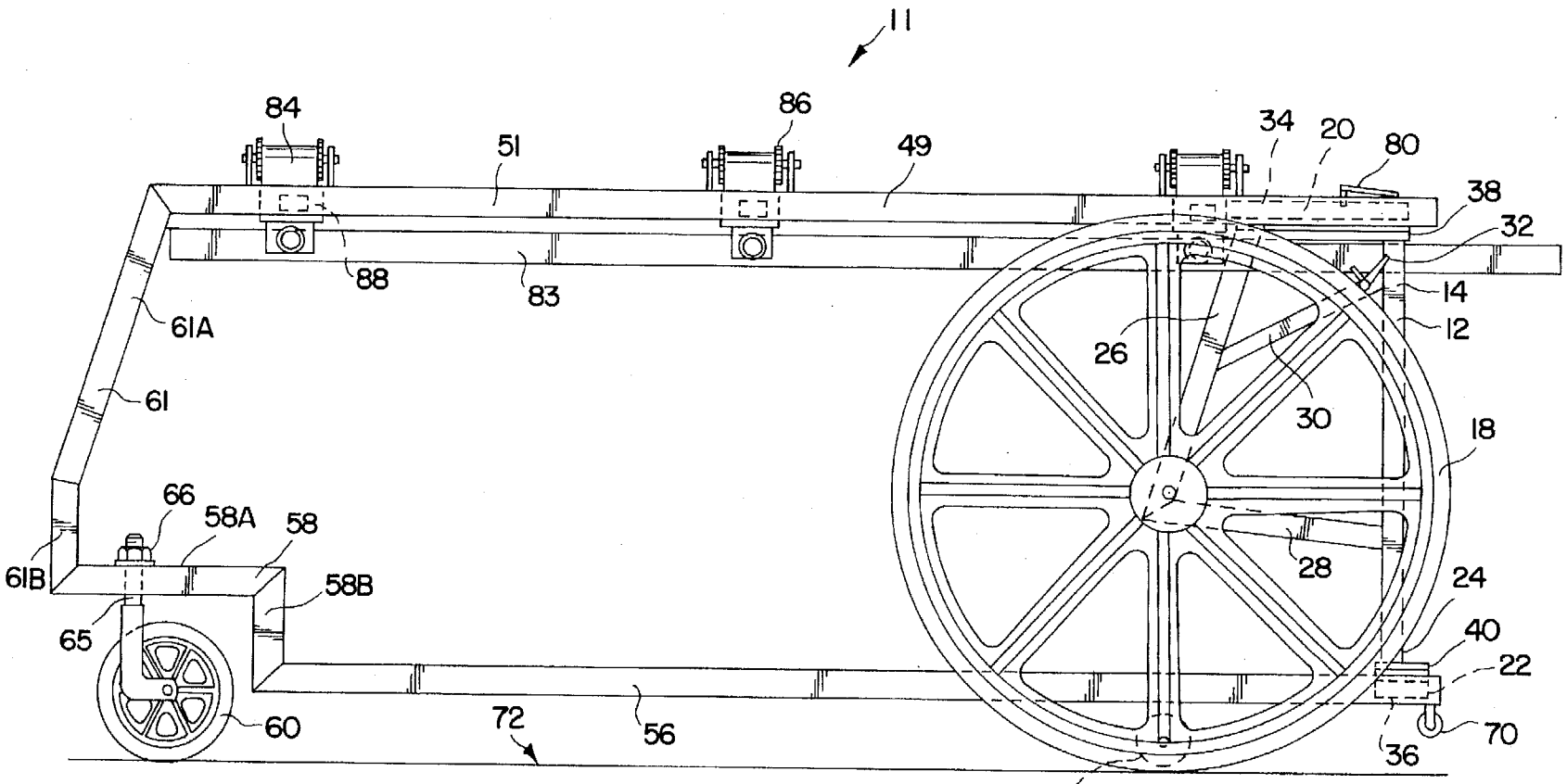
FIG. 8 is a side view of the alternate vehicle 11 of the alternate embodiment of the present invention showing the flat board 83 and the extended second frame 49.

A chair 82 is provided between the sides 50 and 52 of the second frame 48 preferably extending forward of the drive wheels 18 when the wheelchair 10 is in the transport position (FIG. 1). In an alternate embodiment, the alternate vehicle 11 is provided with another type of support such as a stretcher (not shown) or flat board 83 which allows the alternate vehicle 11 to be used as a transporting vehicle to carry a person in the prone or supine position (FIG. 8). In the alternate embodiment, an extended second frame 49 provides the additional support needed for the flat board 83. Support bars (not shown) may be provided between the sides 51 (one shown) of the extended second frame 49 in order to further provide support for the extended second frame 49 and to prevent twisting of the extended second frame 49. In the preferred embodiment, the chair 82 is supported between the sides 50 and 52 of the second frame 48 by belts 84 connected between the chair 82 and ratchets 86 mounted on the top rails 54 of the second frame 48. The ratchets 86 are preferably similar to conventional ratchets and allow the user to incrementally lower the chair 82. In the preferred embodiment, there are two ratchets 86 on each side 50 and 52 of the second frame 48 (FIGS. 3 and 7). In the alternate embodiment, there are preferably three (3) ratchets 86 and belts 84 on each side 51 of the extended second frame 49 in order to support the entire length of the flat board 83 (FIG. 8). The flat board 83 is preferably of a length such that an average adult person can lie on the flat board 83 and be entirely supported. The belts 84 are preferably attached to the chair 82 by a standard seat belt fastener 88 which allows easy release of the chair 82 from the wheelchair 10 (FIG. 1). Other forms of quick-release mechanisms can also be used.

Preferably, the bottom 82A of the chair 82 is provided with a lifting system 90 comprised of lifting bellows 92 and a compressor (not shown). The compressor is used to provide air to the bellows 92 which expand and lift the chair 82. A similar system would be used if some other type of support such as the flat board 83 were used instead of a chair 82. Other raising and lowering means may also be used such as electrically powered motors for raising and lowering the chair 82 or other support. The quick release mechanism and the system to raise and lower the chair 82 or support should be such that the user can easily lower and release and raise and reattach the chair 82 without outside assistance. Preferably, the chair 82 is constructed from a rigid or semi-rigid material and may include a cushion material on the upper surface to increase the comfort of the user. A leg and/or foot support (not shown) can also be provided preferably attached between the sides 50 and 52 of the second frame 48. Preferably, the leg and/or foot support are spaced above the ground surface 72 such as to avoid contact with the horizontal connector bars 63 and 64 of the second frame 48 as the wheelchair 10 is moved into the transfer position.

IN USE

In the preferred embodiment, the wheelchair 10 of the present invention is used to transport and transfer the user (not shown) sitting in the wheelchair 10 to and from and into and out of the passenger seat 102 or alternately, the driver seat (not shown) of an automotive vehicle 100. Alternatively, the user could be lying on the stretcher-like version of the alternate vehicle 11 (FIG. 8) and could be transported to and transferred into an emergency vehicle (not shown), van (not shown) or some other type of vehicle. The wheelchair 10 can be used for other methods of transfer which do not include an automotive vehicle 100 such as between furniture such as chairs (not shown) or beds (not shown). To use the wheelchair 10 to transfer a user into an automotive vehicle 100, the wheelchair 10 is positioned adjacent the passenger seat 102 of the automotive vehicle 100 within the open doorway 104. The wheelchair 10 is positioned such that the drive wheels 18 are adjacent the open doorway 104 and are in contact with the frame 106 (FIGS. 5 and 6). Once in position, the brakes 32 of the wheelchair 10 are applied in order to prevent the drive wheels 18 from rotating and the wheelchair 10 from moving. The position lock 80 is then released so that the first frame 12 is able to slide within the rails 54 and 56 of the second frame 48. To move the second frame 48, the user grabs hold of the drive wheels 18 of the wheelchair 10 and pushes himself, the second frame 48 and the chair 82 backward or toward the open doorway 104. The user can use any fixed object such as the first frame 12, the drive wheels 18 or a portion of the automotive vehicle 100 from which to gain leverage to push himself. Alternatively, a second person could assist the user and could actually push or pull the second frame 48, the user or the chair 82 toward the open doorway 104.

As the second frame 48 moves toward the open doorway 104, the second frame 48 tilts due to the position of the stationary drive wheels 18 acting as a fulcrum in relation to the moving weight of the user. As the second frame 48 tilts, the front wheels 60 lift away from and off the ground surface 72 while the intermediate wheels 68 make contact with the ground surface 72 to assist in the easy movement of the second frame 48 (FIG. 2). In addition, if the second frame 48 tilts too far, the stabilizing wheels 70 come into contact with the ground surface 72 and prevent further tilting. As the second frame 48 moves toward the open doorway 104, the ends of the bottom rails 56, opposite the step section 58, extend beneath the frame 106 of the open doorway 104 of the receiving vehicle 100. During transfer, the bottom rails 56 of the second frame 48 are preferably only slightly spaced above the ground surface 72 such as to be able to easily fit beneath the frame 106 of the open doorway 104 of the automotive vehicle 100. The top rails 54 of the second frame 48 extend into the open doorway 104 of the automotive vehicle 100 until the chair 82 is positioned over the passenger seat 102 of the automotive vehicle 100. In the preferred embodiment, when the top and bottom sliding mechanisms 34 and 36 of the first frame 12 are adjacent the front sections 61 and 62 and step section 58 of the second frame 48, respectively, the chair 82 is positioned over the seat 102 of the automotive vehicle 100 (FIG. 5). In this position, the wheelchair 10 is preferably in the final transfer position and the center of the drive wheels 18 and the connection of the vertically angled bar 26 and the first horizontally angled bar 28 of the first frame 12 are preferably adjacent the intersection of the angled upper portion 61A and the vertical lower portion 61B of the front section 61 of the second frame 48 (FIG. 2). However, it is also possible that the chair 82 would be correctly positioned over the passenger seat 102 prior to full movement of the second frame 12 along the first frame 48.

Once the chair 82 is in the correct position over the passenger seat 102, the user gently lowers the chair 82 vertically onto the seat 102 of the automotive vehicle 100 using the ratchets 86 (FIG. 6). When the chair 82 is positioned on the passenger seat 102 of the automotive vehicle 100, the user releases the fasteners 88 to release the chair 82 from the wheelchair 10. The wheelchair 10 can then be removed from the open doorway 104. Preferably to remove the wheelchair 10, the second frame 48 is moved back into the transport position and the first and second frames 12 and 48 are locked together using the position lock 80. The brakes 32 are then released and the wheelchair 10 is removed. Once the second frame 48 is out of the way, the user can rotate the chair 82 on the seat 102 such that the user is facing forward. Next, the user can fasten the chair 82 onto the seat 102 using seat belts (not shown) similar to those used in a standard vehicle. Other seat belts or restraints could also be used to fasten the user into the chair 82 and the chair 82 onto the seat 102 to prevent possible injury to the user in the event the automotive vehicle 100 is involved in an accident.

To transfer from the automotive vehicle 100 to the wheelchair 10, the user unfastens the necessary seat belts and inflates the lifting bellows 92 in order to vertically raise the chair 82 (FIG. 5). Once raised, the user rotates the chair 82 such that he is facing out the open doorway 104 of the automotive vehicle 100. The user could also rotate the chair 82 prior to activating the lifting system 90. Next, the wheelchair 10 is moved into position and the brake 32 applied, the second frame 48 is then slid into the open door of the automotive vehicle 100 and the above procedure is then repeated in reverse.

Numerous variations will occur to those skilled in the art. It is intended that the foregoing descriptions be only illustrative of the present invention and that the present invention be only limited by the hereinafter appended claims.

We claim:

1. A vehicle for allowing transport and transfer of a person to and from and into and out of a receiving surface, which comprises:

(a) a first frame mounted on a pair of spaced apart wheels having a common axis of rotation;

(b) a second frame having a first end and a second end and slidably connected to the first frame for movement along a horizontal direction along the first frame, the second frame having first wheels at the first end and second wheels intermediate the first and second ends and including spaced apart first and second sides, each of the sides having spaced apart and parallel top and bottom rails, wherein when the second frame is moved along the first frame with the wheels of the first frame and the first end of the second frame moving toward each other, the second frame tilts so that the second wheels engage a ground surface for supporting the second frame during the movement; and (c) a support means having a support surface and mounted on the second frame so that the support means is spaced between the first and second sides of the second frame with the support surface of the support means spaced between the top and bottom rails of the sides of the second frame for supporting the person during transport and transfer wherein to transfer the person from the vehicle to the receiving surface, the vehicle is positioned adjacent the receiving surface and the second frame is moved along the first frame such that the support means of the vehicle is above and adjacent to the receiving surface.

2. The vehicle of claim 1 wherein the first frame includes spaced apart first and second sides, each of the sides having spaced apart and parallel top and bottom portions.

3. The vehicle of claim 2 wherein a top and a bottom sliding mechanism are mounted on the top and bottom portions of each of the sides of the first frame so as to engage the second frame at corresponding parallel top and bottom rails of the second frame.

4. The vehicle of claim 3 wherein extensions are provided between the top and bottom sliding mechanisms and the top and bottom portions of the first frame, respectively, for mounting the top and bottom sliding mechanism to the top and bottom portions of the first frame.

5. The vehicle of claim 4 wherein the sliding mechanisms include a tubular member having rollers provided on all sides along the length of the tubular member, and wherein the rollers engage the top and bottom rails of the second frame.

6. The vehicle of claim 4 wherein an opening and a slot are provided along a length of each of the rails and wherein the sliding mechanisms of the first frame are mounted in the openings of the top and bottom rails so as to allow the first frame to move along the length of the top and bottom rails.

7. The vehicle of claim 6 wherein the extensions extend through the slots of the top and bottom rails.

8. The vehicle of claim 3 wherein a locking means mounted on the top rail of the second frame engages the top sliding mechanism of the first frame and holds the first and second frames of the vehicle in an initial transport position.

9. The vehicle of claim 1 wherein the support means is removably mounted between the first and second sides of the second frame by straps.

10. The vehicle of claim 9 wherein a rachet system is connected between the straps and the second frame for incrementally raising and lowering the support means vertically.

11. The vehicle of claim 10 wherein disconnect means are mounted on the straps between the support means and the second frame for removing the support means from the second frame.

12. The vehicle of claim 11 wherein the disconnect means are seat belt buckles.

13. The vehicle of claim 1 wherein a braking means is mounted on the first frame to engage the wheels of the first frame to selectively prevent rotation of the wheels.

14. The vehicle of claim 1 wherein the second frame is provided with a stabilizing wheel adjacent the second end to prevent overturning of the vehicle when the wheels of the first frame are toward the first end of the second frame.

15. The vehicle of claim 1 wherein an axis of the second wheels of the second frame is aligned with the axis of the wheels of the first frame and the second wheels of the second frame are spaced above the ground surface when the vehicle is in an initial transport position.

16. The vehicle of claim 1 wherein the support means is provided with a lifting means for raising the support means vertically.

17. The vehicle of claim 1 wherein the support means is a chair.

18. A wheelchair for allowing transport and transfer of a person to and from and into and out of a receiving vehicle, which comprises:

a first frame mounted on a pair of spaced apart, hand driveable drive wheels having a common axis of rotation;

a second frame having a first end and a second end and slidably connected to the first frame for movement along a horizontal direction along the first frame, the second frame having first wheels at the first end and second wheels intermediate the first and second ends and including spaced apart first and second sides, each of the sides having spaced apart and parallel top and bottom rails, wherein when the second frame is moved along the first frame with the drive wheels moved toward the first end of the second frame, the second frame tilts so that the second wheels engage a ground surface for supporting the second frame during the movement; and a chair having a support surface and mounted on the second frame so that the chair is spaced between the first and second sides of the second frame with the support surface of the chair spaced between the top and bottom rails of the sides of the second frame for supporting the person during transfer from and into the receiving vehicle wherein the rotation of the drive wheels of the first frame is prevented while the second frame is moved into the receiving vehicle and wherein to transfer the person from the wheelchair to the receiving vehicle, the wheelchair is positioned adjacent the receiving vehicle and the second frame is moved along the first frame such that the chair of the wheelchair is above and adjacent a seat of the receiving vehicle.

19. The wheelchair of claim 18 wherein the first frame includes spaced apart first and second sides, each of the sides having spaced apart and parallel top and bottom portions.

20. The wheelchair of claim 19 wherein a top and a bottom sliding mechanism are mounted on the top and bottom portions of each of the sides of the first frame so as to engage corresponding parallel top and bottom rails of the second frame.

21. The wheelchair of claim 20 wherein extensions are provided between the top and bottom sliding mechanisms and the top and bottom portions of the first frame, respectively, for mounting the top and bottom sliding mechanism to the top and bottom portions of the first frame.

22. The wheelchair of claim 21 wherein an opening and a slot are provided along a length of each of the rails and wherein the sliding mechanisms of the first frame are mounted in the openings of the top and bottom rails so as to allow the first frame to move along the length of the top and bottom rails.

23. The wheelchair of claim 22 wherein the extensions extend through the slots of the top and bottom rails.

24. The wheelchair of claim 20 wherein the sliding mechanisms include a tubular member having rollers provided on all sides along the length of the tubular member and wherein the rollers engage the top and bottom rails of the second frame.

25. The wheelchair of claim 20 wherein a locking means mounted on the top rail of the second frame engages the top sliding mechanism of the first frame and holds the first and second frames of the wheelchair in a transport position.

26. The wheelchair of claim 18 wherein the chair is removably mounted between the first and second sides of the second frame by straps.

27. The wheelchair of claim 26 wherein a rachet system is connected between the straps and the second frame for incrementally raising and lowering the chair vertically.

28. The wheelchair of claim 27 wherein disconnect means are mounted on the straps between the chair and the second frame for detaching the chair from the second frame.

29. The wheelchair of claim 28 wherein the disconnect means are seat belt buckles.

30. The wheelchair of claim 18 wherein a braking means is mounted on the first frame to engage the driving wheels to selectively prevent rotation of the driving wheels.

31. The wheelchair of claim 18 wherein the second end of the second frame is provided with a stabilizing wheel to prevent overturning of the wheelchair when the first end of the second frame is approaching the drive wheels during transfer.

32. The wheelchair of claim 18 wherein an axis of the second wheels of the second frame is aligned with the axis of the wheels of the first frame and the second wheels of the second frame are spaced above the ground surface when the wheelchair is in a transport position.

33. A wheelchair for allowing transport and transfer of a person to and from and into and out of a receiving vehicle, which comprises:

(a) a first frame having spaced apart first and second sides, each side having spaced apart, parallel top and bottom portions and each side connected to spaced apart hand driveable drive wheels having a common axis of rotation;

(b) a second frame having a first end and a second end slidably connected to the first frame for movement along a horizontal direction along the first frame and having spaced apart first and second sides with each side having spaced apart top and bottom rails, each bottom rail having a first wheel at the first end and a second wheel intermediate the first and second ends, wherein the top rail of the second frame is slidably connected to the top portion of the first frame and the bottom rail of the second frame is slidably connected to the bottom portion of the first frame to allow the second frame to move while the first frame remains stationary; and (c) a chair having a support surface and mounted between the sides of the second frame so that the chair is spaced between the first and second sides of the second frame with the support surface of the chair spaced between the top and bottom rails of the sides of the second frame wherein to transfer the person from the wheelchair to the receiving vehicle, the wheelchair is positioned adjacent the receiving vehicle and the second frame is moved along the first frame such that the chair of the wheelchair is above and adjacent a seat of the receiving vehicle.

34. A method for transporting and transferring a person to and from and into and out of a receiving surface, which comprises:

(a) providing a vehicle having a first frame mounted on a pair of spaced apart wheels having a common axis of rotation; a second frame having a first end and a second end, slidably connected to the first frame for movement along a horizontal direction along the first frame, the second frame having first wheels at the first end and second wheels intermediate the first and second ends and including spaced apart first and second sides, each of the sides having spaced apart and parallel top and bottom rails; a support means having a support surface and mounted on the second frame so that the support means is spaced between the first and second sides of the second frame with the support surface of the support means spaced between the top and bottom rails of the sides of the second frame for supporting the person during transfer;

(b) positioning the vehicle adjacent the receiving surface;

(c) sliding the frames so that the first end of the second frame and the wheels of the first frame move toward each other wherein the second frame tilts so that the second wheels engage a ground surface for supporting the second frame during the movement and wherein the support means of the vehicle is above and adjacent the receiving surface; and (d) removing the person from the vehicle.

35. A method of claim 34 wherein before step (b), a brake mounted on the first frame is activated for engaging at least one of the wheels of the first frame to hold the first frame in a fixed position.

36. A method of claim 34 wherein before step (c), a rachet means mounted between the support means and the second frame is used for lowering the support means in increments for easier removal of the person from the vehicle.

37. A method of claim 34 wherein in step (c), the person and the support means of the vehicle are removed from the vehicle together so that the person remains supported by the support means after removal from the vehicle.

38. A method for transporting and transferring a person to and from and into and out of a receiving vehicle, which comprises:

(a) providing a wheelchair having a first frame mounted on a pair of spaced apart driveable drive wheels having a common axis of rotation; a second frame having a first end and a second end and slidably connected to the first frame for movement along a horizontal direction along the first frame, the second frame having first wheels at the first end and second wheels intermediate the first end and the second end, wherein when the second frame is moved along the first frame with the first end of the second frame moved towards the drive wheels, the second frame tilts so that the second wheels engage a ground surface for supporting the second frame during the movement; and a chair mounted on the second frame for supporting the person during transport to and from and out of transfer and into the receiving vehicle wherein rotation of the drive wheels of the first frame is prevented while the second frame is moved adjacent the receiving vehicle;

(b) positioning the wheelchair adjacent an open door of the receiving vehicle so that the drive wheels are adjacent the receiving vehicle;

(c) holding the wheelchair in a fixed position;

(d) sliding the second frame toward the open door so that the chair is spaced above a seat of the receiving vehicle;

(e) lowering the chair of the wheelchair onto the seat of the receiving vehicle and removing the chair from the second frame; and (f) rotating the chair of the wheelchair on the seat of the receiving vehicle so that the person is correctly positioned in the receiving vehicle.

39. The method of claim 38 wherein in step (c), a brake mounted on the first frame is applied for engaging at least one of the driving wheels to hold the wheelchair in a fixed position.

40. The method of claim 38 wherein in step (e), a ratchet means mounted to the second frame is used for lowering the chair in increments onto the seat of the receiving vehicle.

41. The method of claim 38 wherein after step (f), the person and the chair of the wheelchair are fastened into the seat of the receiving vehicle using a seat belt.

* * * * *